US008544144B2

(12) United States Patent
Ji et al.

(10) Patent No.: US 8,544,144 B2
(45) Date of Patent: Oct. 1, 2013

(54) VACUUM CLEANER AND DUST SEPARATION APPARATUS THEREOF

(75) Inventors: Heon-Pyeong Ji, Changwon (KR); Hae-Seock Yang, Changwon (KR); Young-Min Hyun, Changwon (KR); Hyuk-Joo Kwon, Changwon (KR); Hyo-Churl Shin, Changwon (KR); Sang-Jun Park, Changwon (KR); Jin-Wook Seo, Changwon (KR)

(73) Assignee: LG Electronics Inc., Seoul (KR)

( * ) Notice: Subject to any disclaimer, the term of this patent is extended or adjusted under 35 U.S.C. 154(b) by 444 days.

(21) Appl. No.: 12/918,113

(22) PCT Filed: Feb. 12, 2009

(86) PCT No.: PCT/KR2009/000689

§ 371 (c)(1),
(2), (4) Date: Sep. 16, 2010

(87) PCT Pub. No.: WO2009/104878

PCT Pub. Date: Aug. 27, 2009

(65) Prior Publication Data

US 2011/0000047 A1 Jan. 6, 2011

(30) Foreign Application Priority Data

Feb. 19, 2008 (KR) ..... 10-2008-0014731

(51) Int. Cl.
*A47L 9/10* (2006.01)

(52) U.S. Cl.
USPC ..... 15/352; 15/327.2

(58) Field of Classification Search
USPC ..... 15/347, 352, 353, 327.1, 327.2; 55/432
See application file for complete search history.

(56) References Cited

U.S. PATENT DOCUMENTS

| | | | | |
|---|---|---|---|---|
| 7,175,682 | B2 * | 2/2007 | Nakai et al. | 55/429 |
| 7,611,558 | B2 * | 11/2009 | Oh et al. | 55/432 |
| 7,857,878 | B2 * | 12/2010 | Park et al. | 55/337 |
| 8,021,453 | B2 * | 9/2011 | Howes | 55/447 |
| 8,156,609 | B2 * | 4/2012 | Milne et al. | 15/344 |
| 2006/0123749 | A1 | 6/2006 | Park | 55/428 |
| 2008/0264015 | A1 * | 10/2008 | Oh et al. | 55/429 |
| 2009/0100634 | A1 * | 4/2009 | Bates et al. | 15/347 |
| 2009/0178230 | A1 * | 7/2009 | Yoo | 15/347 |

FOREIGN PATENT DOCUMENTS

| | | | |
|---|---|---|---|
| DE | 101 10 581 | A1 | 11/2001 |
| JP | 2000-342492 | | 12/2000 |
| KR | 10-2006-0067145 | | 6/2006 |
| KR | 10-2007-0088023 | A | 8/2007 |
| KR | 10-0800189 | | 1/2008 |
| RU | 2 301 010 | C2 | 6/2007 |
| WO | WO 2008/100005 | A1 | 8/2008 |

OTHER PUBLICATIONS

Korean Office Action dated Jul. 30, 2009 issued in Application No. 10-2008-0014731.

(Continued)

*Primary Examiner* — Dung Van Nguyen
(74) *Attorney, Agent, or Firm* — KED & Associates, LLP

(57) ABSTRACT

Provided is a dust separation apparatus of a vacuum cleaner. The apparatus includes a dust-collecting body defining a dust-storing part, a compressing member configured to compress dust stored in the dust-collecting body, and a lower cover on a lower side of the dust-collecting body, the lower cover opening and closing the dust-storing part.

15 Claims, 6 Drawing Sheets

(56) References Cited

OTHER PUBLICATIONS

Korean Notice of Allowance dated Jan. 25, 2010 issued in Application No. 10-2008-0014731.
Australian Notice of Allowance dated Jul. 28, 2011 issued in Application No. 2009216047.
Russian Office Action dated May 6, 2011 issued in Application No. 2010138546 (with translation).
International Search Report Issued in PCT/KR2009/000689 dated Sep. 9, 2009.

* cited by examiner

VACUUM CLEANER AND DUST SEPARATION APPARATUS THEREOF

TECHNICAL FIELD

The present disclosure relates to a vacuum cleaner and a dust separation apparatus of the vacuum cleaner.

BACKGROUND ART

In general, a vacuum cleaner is an apparatus that uses a suction force generated by a suction motor installed in a main body to suck air including dust and filter the dust within a dust separation unit.

Such a vacuum cleaner includes a main body provided with a suction motor, a dust separation unit separating dust from sucked air, and a dust container in which the dust separated from the dust separation unit is stored.

The suction motor is driven to suck air to the main body, and the sucked air moves to the dust separation unit. The dust is separated from the air within the dust separation unit, and the separated dust is introduced into the dust container.

DISCLOSURE OF INVENTION

Technical Problem

Embodiments provide a vacuum cleaner and a dust separation apparatus of the vacuum cleaner, which improve a dust-collecting capacity of a dust container.

Embodiments also provide a vacuum cleaner and a dust separation apparatus of the vacuum cleaner, which are configured to easily remove dust from a dust container.

Technical Solution

In one embodiment, a dust separation apparatus of a vacuum cleaner includes: a dust-collecting body defining a dust-storing part; a compressing member configured to compress dust stored in the dust-collecting body; and a lower cover on a lower side of the dust-collecting body, the lower cover opening and closing the dust-storing part.

In another embodiment, a vacuum cleaner includes: a main body including a suction motor configured to generate a suction force; a dust container configured to communicate with the suction motor, the dust container including a dust-collecting body configured to store dust and a lower cover configured to open and close a lower side of the dust-collecting body; a compressing member configured to compress the dust stored in the dust-collecting body; and a driving device configured to drive the compressing member.

The details of one or more embodiments are set forth in the accompanying drawings and the description below. Other features will be apparent from the description and drawings, and from the claims.

Advantageous Effects

According to the embodiments, the compressing member compresses dust stored in the dust-collecting body so as to improve the dust-collecting capacity of the dust-collecting body.

Also, since dust is compressed, the dust-collecting capacity of the dust-collecting body is maximized. This reduces frequency at which a user removes dust from the dust-collecting body.

Also, since the lower cover opening and closing the dust-collecting body is disposed on the lower side of the dust-collecting body, dust is easily discharged after rotating the lower cover.

MODE FOR THE INVENTION

Reference will now be made in detail to the embodiments of the present disclosure, examples of which are illustrated in the accompanying drawings.

Figure 1:
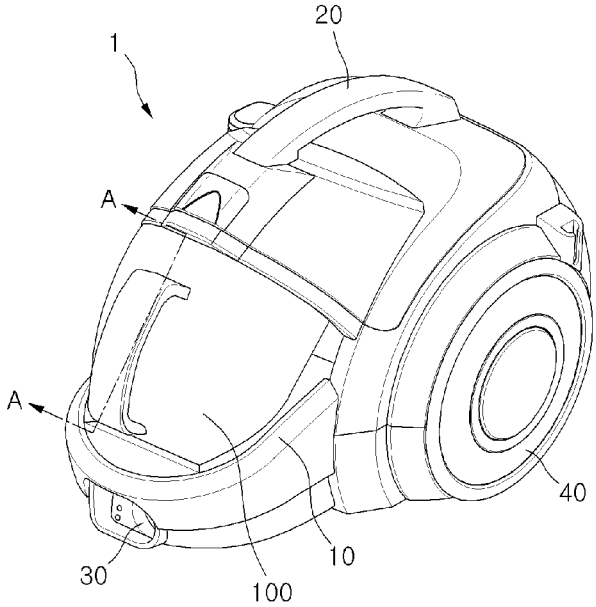
FIG. 1 is a perspective view illustrating a vacuum cleaner to which a dust container is installed, according to an embodiment.
Figure 2:
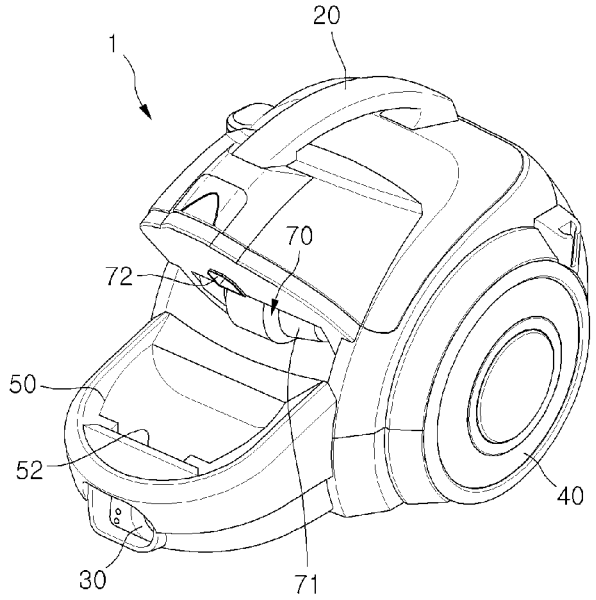
FIG. 2 is a perspective view illustrating the vacuum cleaner from which the dust container is detached, according to the embodiment of FIG. 1.

FIG. 1 is a perspective view illustrating a vacuum cleaner 1 having a dust container 100 according to one embodiment. FIG. 2 is a perspective view illustrating the vacuum cleaner 1 from which the dust container 100 is detached, according to the embodiment of FIG. 1.

Referring to FIGS. 1 and 2, the vacuum cleaner 1 includes a main body 10 having a suction motor generating suction force and a dust separation apparatus separating dust from sucked air.

The main body 10 includes a main body introduction part 30, wheels 40 effectively moving the main body 10, and a main body handle 20 adapted to hold the main body 10. The main body introduction part 30 introduces air, sucked from a target surface, to the main body 10.

Although not shown, the vacuum cleaner 1 includes a suction nozzle sucking a foreign substances from the target surface to be cleaned, an extension tube guiding air sucked from the suction nozzle to the main body 10, a handle coupled to the extension tube, and a connection tube providing air passing through the extension tube to the main body 10.

The dust separation apparatus includes a dust separation unit 70 separating dust from air sucked into the main body 10, and the dust container 100 detachably attached to the main body 10. Dust separated from the dust separation unit 70 is stored in the dust container 100.

Particularly, the main body 10 includes an install part 50 where the dust container 100 is installed, and a lower seat surface 52 provided to the install part 50. A lower end of the dust container 100 seats on the lower seat surface 52 in the state where the dust container 100 is installed to the install part 50.

The dust separation unit 70 includes a cyclone part 71 forming cyclone airflow to separate dust from air sucked into the dust separation unit 70, and a dust-discharging part 72 discharging dust separated by the cyclone airflow to the dust container 100.

The dust-discharging part 72 communicates with the dust container 100 in the state where the dust container 100 is installed to the main body 10.

Although not shown, the cyclone part 71 may be provided with a plurality of air-sucking parts sucking air including dust into the cyclone part 71.

The air-sucking parts are disposed on both sides of the cyclone part 71, and the dust-discharging part 72 may be disposed between the air-sucking parts.

Figure 3:
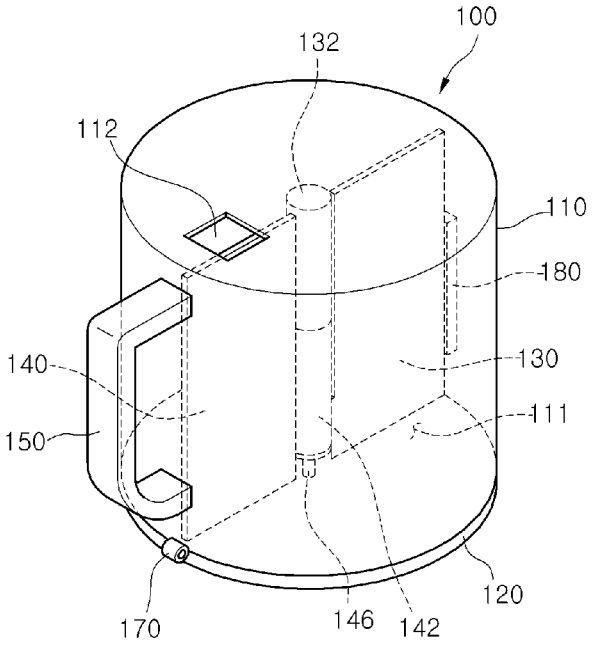
FIG. 3 is a perspective view illustrating a close state of a lower cover of the dust container according to the embodiment of FIG. 1.
Figure 4:
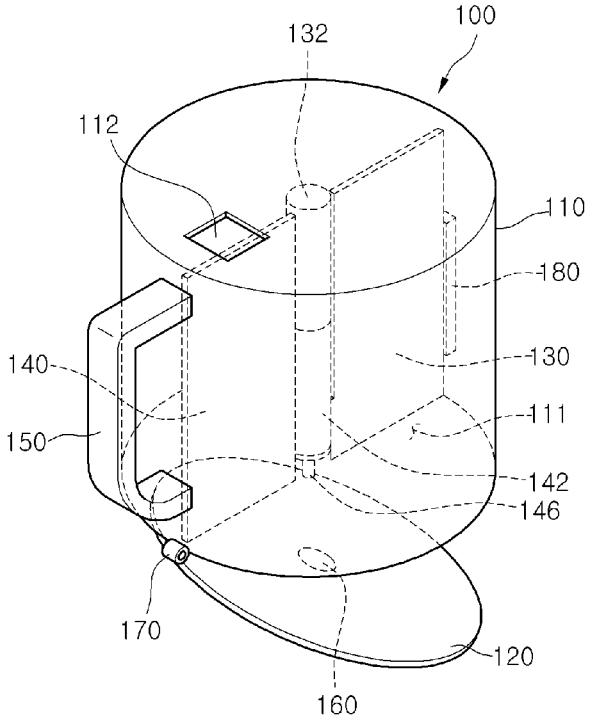
FIG. 4 is a perspective view illustrating an open state of the lower cover of the dust container according to the embodiment of FIG. 1.

FIG. 3 is a perspective view illustrating a close state of a lower cover 120 of the dust container 100 according to the embodiment of FIG. 1. FIG. 4 is a perspective view illustrating an open state of the lower cover 120 of the dust container 100 according to the embodiment of FIG. 1.

Referring to FIGS. 3 and 4, the dust container 100 includes a dust-collecting body 110 provided with a dust-storing part 111 and having an open lower surface, the lower cover 120 provided on a lower side of the dust-collecting body 110 and selectively opening the lower surface of the dust-collecting body 110, and a handle 150 provided on one side of the dust-collecting body 110 and adapted to easily hold the dust container 100. Dust is stored in the dust-storing part.

A top surface of the dust-collecting body 110 is provided with a dust-introducing part 112 for introducing dust discharged from the dust separation unit 70.

A side of the lower cover 120 is rotatably coupled to the dust-collecting body 110 through a hinge 170.

The dust-collecting body 110 is provided with a fixed member 130 (which may be referred to as a first compressing member) for compressing dust stored in the dust-storing part 111, and a compressing member 140 (which may be referred to as a second compressing member).

The fixed member 130 is fixed in the dust-collecting body 110. For example, the fixed member 130 may be formed integrally with the dust-collecting body 110 in a single body.

The compressing member 140 is movably installed in the dust-collecting body 110. For example, the compressing member 140 may be rotatably installed in the dust-collecting body 110.

The dust-collecting body 110 is provided with a fixed shaft 132, and the fixed member 130 may be formed integrally with the fixed shaft 132 in a single body. For example, the fixed shaft 132 may be formed integrally with the top surface of the dust-collecting body 110 in a single body.

The compressing member 140 includes a rotation shaft 142 that is rotatably installed to the fixed shaft 132. The fixed shaft 132 guides rotation of the rotation shaft 142, so that the rotation shaft 142 stably rotates. That is, the fixed shaft 132 functions as a guide part for guiding movement of the compressing member 140.

A lower side of the rotation shaft 142 is provided with a connection part 146 connected to a driving device that will be described later. The lower cover 120 is provided with a connection hole 160 through which the connection part 146 passes.

An outer side of the dust-collecting body 110 is provided with a pressing part 180 to open the lower cover 120 downward. The pressing part 180 is pressed to move downward, and thus, the lower cover 120 is released and opened. Configuration and operation thereof will be described later with reference to the accompanying drawings.

Figure 5:
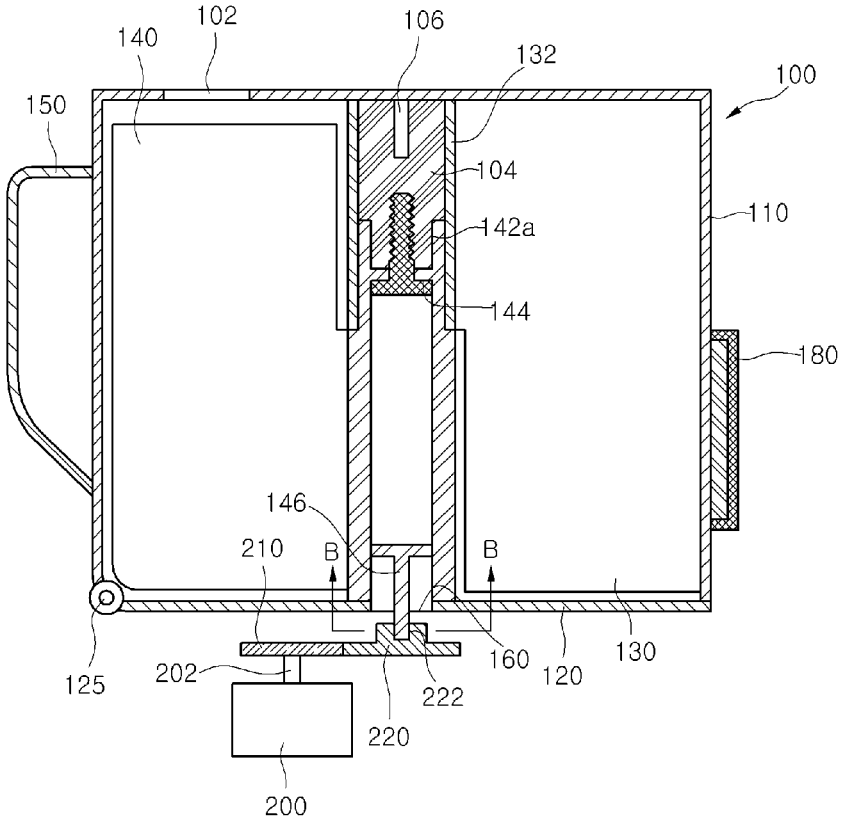
FIG. 5 is a cross-sectional view taken along line A-A of FIG. 1.
Figure 6:
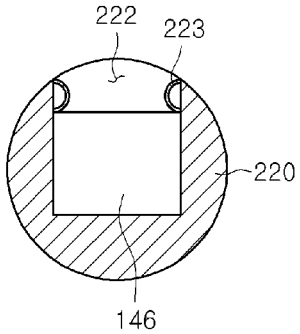
FIG. 6 is a cross-sectional view taken along line B-B of FIG. 5.

FIG. 5 is a cross-sectional view taken along line A-A of FIG. 1. FIG. 6 is a cross-sectional view taken along line B-B of FIG. 5.

Referring to FIGS. 5 and 6, the fixed shaft 132 is disposed in the middle of the top surface of the dust-collecting body 110. A rotation center part 106 is disposed on an inner side of the fixed shaft 132.

The inner side of the fixed shaft 132 is provided with the rotation center part 106 and a rotation member 104 so that the rotation shaft 142 is rotatable, supported by an upper end of the dust-collecting body 110. The rotation member 104 is coupled to the rotation shaft 142 by a coupling member 144.

The rotation center part 106 is fixed to the top surface of the dust-collecting body 110, and the rotation member 104 is rotatable about the rotation center part 106.

At least one portion of an inner surface of the rotation shaft 142 is provided with a friction-generating part 142*a* contacting the rotation member 104. The rotation shaft 142 and the rotation member 104 are simultaneously rotated by a frictional force generated at the friction-generating part 142*a*.

A horizontal cross section of the friction-generating part 142*a* may have a non-circular shape, e.g., a polygonal shape to prevent the rotation member 104 from rotating with no traction while the rotation shaft 142 rotates. A horizontal cross section of the rotation member 104 may have a corresponding shape to that of the friction-generating part 142*a*.

According to the above-described configuration, the compressing member 140 is rotatable, supported by the top surface of the dust-collecting body 110. At this point, a lower end of the rotation shaft 142 is not connected to the lower cover 120.

Thus, while opening the lower cover 120, the dust-collecting body 110 keeps supporting the compressing member 140.

If the rotation shaft 142 is connected to the lower cover 120, while opening the lower cover 120, the rotation shaft 142 and the compressing member 140 rotate together with the lower cover 120. Then, the compressing member 140 interferes with the dust-collecting body 110 because of a radius of gyration of the compressing member 140.

To address this, a lower sectional area of the dust-collecting body 110 must be greater than an upper sectional area.

Thus, according to the configuration of this embodiment, the lower cover 120 rotates downward without variation in the size of the dust-collecting body 110.

In the state where the lower cover 120 closes a lower opening of the dust-collecting body 110, the connection part 146 passes through the connection hole 160 of the lower cover 120 and protrudes toward a lower side of the lower cover 120. For example, a vertical cross section of the connection part 146 may have a T-shape.

The connection hole 160 may be disposed at a corresponding position to the connection part 146. This prevents the connection part 146 from interfering with the lower cover 120 while the lower cover 120 is opened.

The compressing member 140 may be automatically moved by the driving device.

Particularly, the driving device includes a driving source and a power transmission unit transmitting a driving force of the driving source to the compressing member 140 (or the connection part 146).

For example, the driving source may include a driving motor 200.

The power transmission unit includes a first gear 210 connected to a shaft 202 of the driving motor 200, and a second gear 220 engaging with the first gear 210.

The driving motor 200, the first gear 210, and the second gear 220 may be provided to the main body 10. For example, a spur gear may be used as the first gear 210 and the second gear 220.

Although the power transmission unit includes the first gear 210 and the second gear 220 in this embodiment, the power transmission unit may include a single gear. In addition, the configuration of the power transmission unit is not limited.

The second gear 220 may be provided with an insertion hole 222 through which one end of the connection part 146 is inserted. That is, the connection part 146, inserted into the insertion hole 222, rotates together with the second gear 220.

Referring to FIG. 6, the horizontal cross section of the connection part 146 may have a non-circular shape to prevent the connection part 146 from rotating with no traction while the second gear 220 rotates. For example, the horizontal cross section of the connection part 146 may have a tetragonal shape.

One side of the insertion hole 222 is open for the inserting of the connection part 146.

The insertion hole 222 is provided with a separation-preventing part 223 for preventing the connection part 146 from being separated from the insertion hole 222. The separation-preventing part 223 may be deformed during the inserting of the connection part 146. For example, the separation-preventing part 223 may be an elastic member having an elastic force.

Although the insertion hole 222 is open in one direction for the inserting of the connection part 146 in FIG. 6, the insertion hole 222 may be open in various directions to easily insert the connection part 146.

Figure 7:
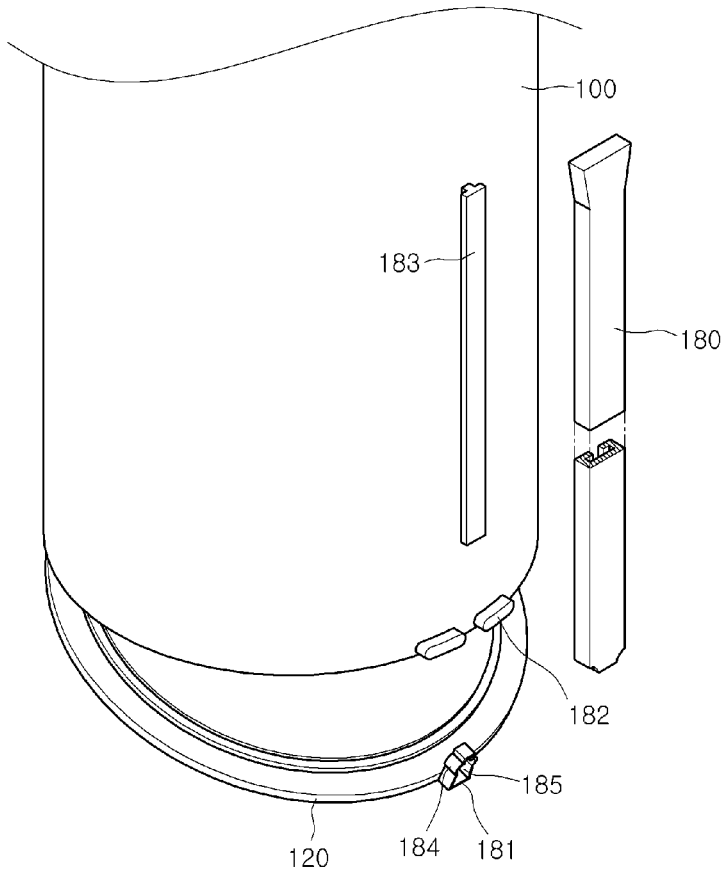
FIG. 7 is a perspective view illustrating an open structure of the lower cover of the dust container according to the embodiment of FIG. 1.
Figure 8:
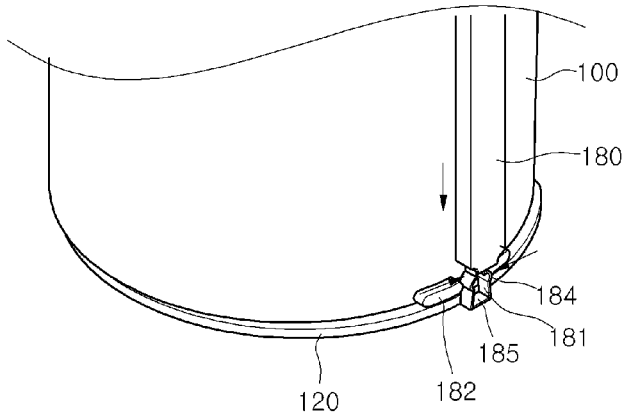
FIGS. 8 and 9 are perspective views illustrating a process of opening the lower cover of the dust container according to the embodiment of FIG. 1.
Figure 9:
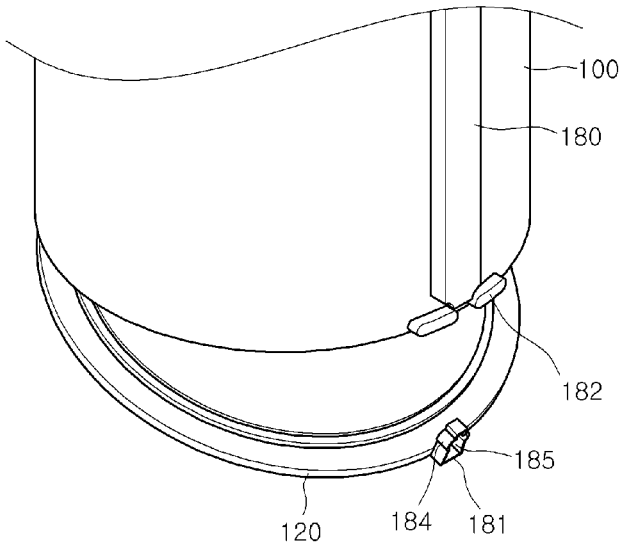

FIG. 7 is a perspective view illustrating an open structure of the lower cover 120 of the dust container 100 according to the embodiment of FIG. 1. FIGS. 8 and 9 are perspective views illustrating a process of opening the lower cover 120 of the dust container 100 according to the embodiment of FIG. 1.

Referring to FIGS. 7 to 9, the dust container 100 includes a catch part 181 disposed on a lower side of the dust container 100 and provided to the lower cover 120, a plurality of catch protrusions 182 for performing a catch operation, the pressing part 180 for opening and closing the lower cover 120 covering the dust container 100, and a guide part 183 for guiding motion of the pressing part 180.

Particularly, the pressing part 180 is removably coupled to the dust container 100 and guided vertically by the guide part 183.

The guide part 183 is provided to a side surface of the dust container 100, and is disposed in a straight line with the catch part 181 when the lower cover 120 is coupled to the dust container 100.

The cross section of the guide part 183 has a "⊥" shape, and the pressing part 180 has a corresponding shape to the guide part 183, so that the pressing part 180 is guided by the guide part 183.

The catch protrusions 182 protrude from the lower end of the dust container 100, and spaced apart from each other to catch both ends of the catch part 181.

The both sides of the catch part 181 are provided with projections 184 that are firmly caught by the catch protrusions 182 when coupling the lower cover 120 to the dust container 100. To couple or remove the catch part 181 to or from the catch protrusions 182, the catch part 181 is provided with a hole 185 for allowing an elastic deformation of the catch part 181.

Hereinafter, the process of opening and closing the dust container 100 will now be described.

First, an upper side of the pressing part 180 is pressed with a predetermined force by a user holding the handle 150, so that the predetermined force is transmitted to the catch part 181. Then, the catch part 181 is elastically deformed because of the hole 185, and thus removed from the catch protrusions 182. At this point, the pressing part 180 is stopped by the catch protrusions 182, and thus prevented from further moving downward.

After dust is removed from the dust container 100, the lower cover 120 is coupled to the dust container 100. Particularly, the lower cover 120 is rotated upward, and simultaneously, the catch part 181 is pushed upward. The catch part 181 is pushed upward to meet the catch protrusions 182, and then, the catch part 181 is elastically deformed and caught to the catch protrusions 182.

Hereinafter, operation of the dust container 100 according to the embodiment will now be described.

First, the dust container 100 is installed to the install part 50. For example, the dust container 100 may slide to the install part 50. When the dust container 100 is installed to the install part 50, the connection part 146 is inserted into the insertion hole 222 of the second gear 220.

At this point, the separation-preventing part 223 prevents the connection part 146 from being separated from the second gear 220.

When the connection part 146 is connected to the second gear 220, the driving motor 200 operates to rotate the first gear 210 and the second gear 220 engaging with the first gear 210.

At this point, the driving motor 200 may operate simultaneously with the suction motor or may operate separately from the suction motor.

The second gear 220 rotates to rotate the connection part 146 in the same direction as that of the second gear 220. Then, the connection part 146 rotates to rotate the rotation shaft 142 and the rotation member 104 about the rotation center part 106.

Then, the compressing member 140 rotates toward the fixed member 130 so as to compress dust in the dust-collecting body 110. That is, the compressing member 140 interacts with the fixed member 130 to compress dust between the compressing member 140 and the fixed member 130.

At this point, the compressing member 140 may be rotated clockwise or counter clock wise by the operation of the driving motor 200. That is, a motor that is rotatable in the both direction, e.g., a synchronous motor may be used as the driving motor 200.

The synchronous motor is rotated in forward and reverse directions by the motor itself, which rotates in the reverse direction when a torque applied to the rotating motor is over a set value.

The torque applied to the motor is a resistance torque generated while the compressing member 140 compresses dust. The motor is configured to change its rotation direction when the resistance torque reaches the set value.

Since the synchronous motor is well known in a related art, a description thereof will be omitted. However, the spirit of the present disclosure includes that the synchronous motor is used as the compressing motor rotated in the forward and reverse direction.

Even when the compressing member 140 arrives at a peak point where the compressing member 140 does not further rotate while compressing dust, the compressing member 140 may keep compressing the dust for a predetermined time. The peak time is a point where the resistance torque reaches at the set value.

When the resistance torque reaches the set value, a current applied to the motor is abruptly increased. Thus, when current variation is detected by a current-sensing part (not shown), the current applied to the motor is cut off for a predetermined time.

Thus, the state of pressing dust is maintained while the compressing member 140 is stopped. After this state, where the compressing member 140 is stopped, is maintained for a predetermined time, power is applied to the motor again to rotate the compressing member 140. Since the time point for cutting off the current applied to the motor is when the resistance torque reaches the set value, the rotation direction of the motor driven again is opposite to that of the motor rotated before the current is cut off.

According to this embodiment, the interaction between the compressing member 140 and the fixed member 130 compresses dust stored in the dust container 100, thereby improving dust-collecting capacity of the dust container 100.

Also, since dust is compressed, the dust-collecting capacity of the dust container 100 is maximized. This reduces frequency at which a user removes dust from the dust container 100.

Also, since the lower cover 120 opening and closing the dust container 100 is disposed on the lower side of the dust container 100, dust is easily discharged after rotating the lower cover 120.

Figure 10:
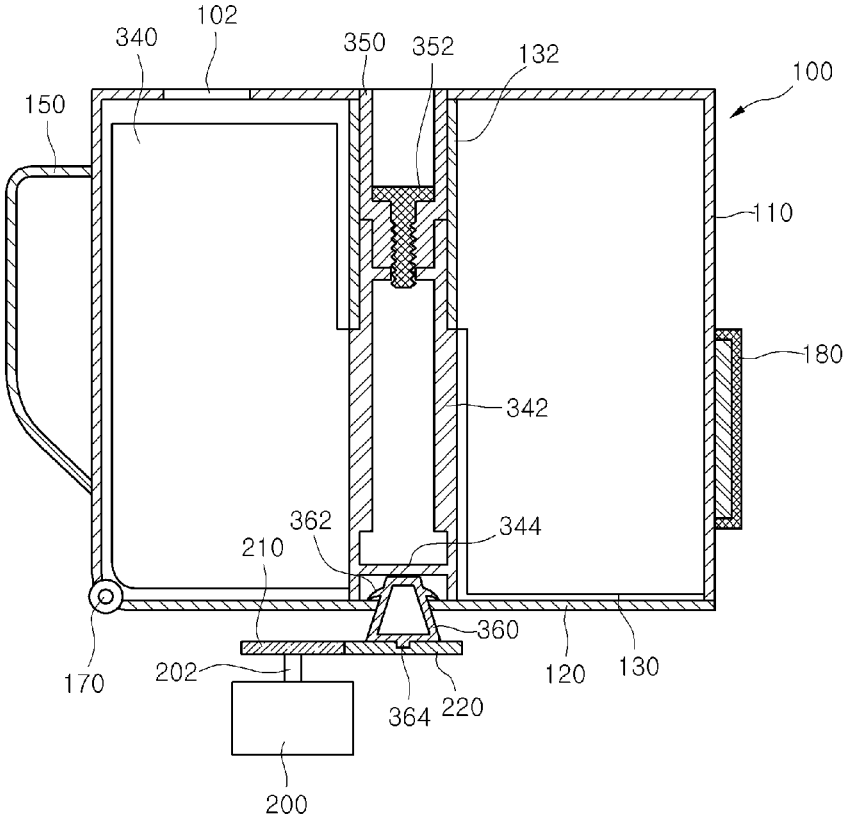
FIG. 10 is a cross-sectional view illustrating structure of a dust container according to another embodiment.

FIG. 10 is a cross-sectional view illustrating structure of the dust container 100 according to an embodiment.

This embodiment is the same as the precedent embodiment except for coupling structure of a compressing member 340, structure of the lower cover 120, and power transmission structure with the driving motor 200. Thus, only characterized part according to this embodiment will now be described.

Referring to FIG. 10, the fixed shaft 132 is disposed in the dust-collecting body 110, and a rotation shaft 342 of the compressing member 340 is rotatably installed to the fixed shaft 132.

Particularly, the rotation shaft 342 is inserted into a lower portion of the fixed shaft 132. In the state where the rotation shaft 342 is inserted into the fixed shaft 132, a fixed part 350 is inserted from an outer side of the dust container to the fixed shaft 132. The fixed part 350 inserted into the fixed shaft 132 is also inserted into the rotation shaft 342. The fixed part 350 is coupled to the rotation shaft 342 through a coupling member 352. Thus, the rotation shaft 342 and the fixed part 350 rotate together.

The lower cover 120 of the dust-collecting body 110 is provided with a connection part 360 for receiving the power of the driving motor 200.

A lower portion of the connection part 360 has a greater sectional area than its upper portion, that is, the connection part 360 has a trapezoid cross section and passes through the lower cover 120.

To prevent the connection part 360 from being separated downward from the lower cover 120, the connection part 360 is provided with catch projections 362 catching the connection part 360 to an inner surface of the lower cover 120. The catch projections 362 have a predetermined elastic force.

The connection part 360 may be connected to the center of the second gear 220. The lower portion of the connection part 360 is provided with a protrusion 364 connecting the connection part 360 to the second gear 220. A manner of connecting the protrusion 364 to the second gear 220 may be the same as the manner of connecting the connection part 146 of the precedent embodiment to the second gear 220.

A top surface of the connection part 360 may be in contact with at least one portion of the rotation shaft 342. The rotation shaft 342 is provided with a compression part 344 that is parallel with the top surface of the connection part 360 and is in surface contact with the top surface of the connection part 360.

That is, in the state where the lower cover 120 is closed, the connection part 360 is compressed to the compression part 344. The connection part 360, compressed to the compression part 344, transmits torque to the rotation shaft 342.

That is, a frictional force enough to transmit the torque may be applied between the connection part 360 and the compression part 344.

The top surface of the connection part 360 may be formed of an elastic material having a predetermined elastic force such that the connection part 360 is in close contact with the compression part 344. Alternatively, a discrete elastic material having a predetermined elastic force may be provided to an upper side of the connection part 360.

Hereinafter, operation of the dust container 100 will now be described according to this embodiment.

The lower cover 120 is coupled to the dust-collecting body 110 and rotatable about the hinge 170. While the lower cover 120 is closed, the connection part 360 is in close contact with the compression part 344.

When the dust container 100 is installed to the install part 50, the connection part 360 is connected to the second gear 220.

In the state where the connection part 360 is connected to the second gear 220, the driving motor 200 operates to transmit the driving force of the driving motor 200 to the first gear 210, the second gear 220, and the connection part 360.

Thus, the connection part 360 rotates according to the rotation of the second gear 220, and the rotation shaft 142 rotates according to the rotation of the connection part 360.

Accordingly, the compressing member 340 rotates toward the fixed member 130, and dust in the dust-collecting body 110 is compressed by the interaction between the compressing member 340 and the fixed member 130.

Hereinafter, another embodiment is provided.

The connection part 360 is in close contact with the second gear 220, so that the connection part 360 rotates together with the second gear 220. That is, when the dust container 100 is installed to the install part 50, the connection part 360 is in close contact with the second gear 220.

Particularly, the protrusion 364 in the embodiment of FIG. 10 is removed, and a bottom surface of the connection part 360 is in surface contact with the second gear 220. That is, the top surface of the connection part 360 is in close contact with the compression part 344 to have a great frictional force, and simultaneously, the bottom surface thereof is in close contact with the second gear 220 to have a great frictional forced.

The "great frictional force" means a frictional force enough to transmit the torque from the second gear 220 to the connection part 360.

Figure 11:
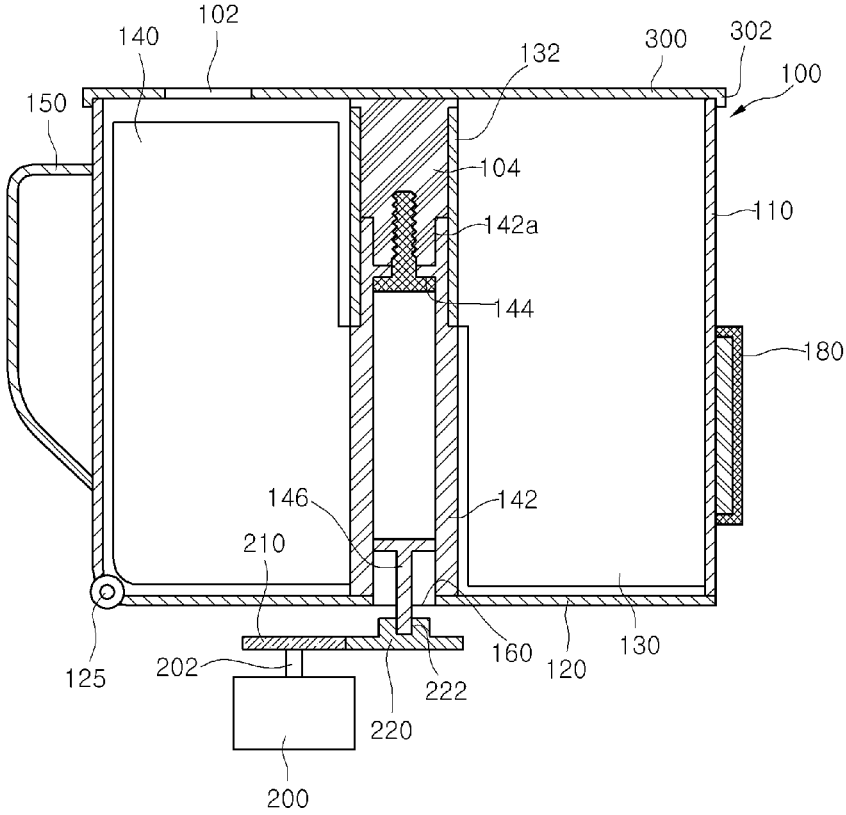
FIG. 11 is a cross-sectional view illustrating structure of a dust container according to another embodiment.

FIG. 11 is a cross-sectional view illustrating structure of the dust container 100 according to another embodiment.

This embodiment is the same as the embodiment of FIG. 1 except for an upper cover 100 for opening and closing the top surface of the dust-collecting body 110. Thus, only characterized part according to this embodiment will now be described.

Referring to FIG. 11, the dust container 100 according to this embodiment further includes the upper cover 300 that is provided to an upper portion of the dust-collecting body 110 to open and close the upper portion of the dust-collecting body 110.

An outer surface of the upper cover 300 is provided with a bent part 302 that is bent downward to surround an upper end of an outer surface of the dust-collecting body 110.

The upper cover 300 can be opened independently. The rotation member 104 may be removable from the upper cover 300. While the upper cover 300 is closed, the rotation member 104 is adjacent to the upper cover 300.

The fixed member 130 is fixed to one side surface of the dust-collecting body 110, and may be removable from the upper cover 300. Since the fixed shaft 132 is formed integrally with the fixed member 130 in a single body, even when the upper cover 300 is removed from the fixed shaft 132, the fixed shaft 132 maintains its fixed position.

The rotation member 104 is inserted to the fixed shaft 132 from an upper portion of the fixed shaft 132. The rotation member 104 inserted into the fixed shaft 132 is also inserted into the rotation shaft 142, and the rotation shaft 142 is coupled to the rotation member 104 through the coupling member 144.

According to this embodiment, any one of the upper cover 300 and the lower cover 120 is opened to discharge dust in the dust container 100 to the outside.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A dust separation apparatus of a vacuum cleaner, the apparatus comprising:

a dust-collecting body defining a dust-storing part;

a compressing member configured to compress dust stored in the dust-collecting body; and a lower cover provided on a lower side of the dust-collecting body, the lower cover opening and closing the dust-storing part, wherein the compressing member comprises a rotation shaft, and the dust-collecting body comprises a fixed shaft configured to guide rotation of the rotation shaft.

2. The apparatus according to claim 1, wherein the compressing member is movably installed with respect to the dust-collecting body.

3. The apparatus according to claim 1, wherein the compressing member comprises a connection part configured to receive power from an external source.

4. The apparatus according to claim 3, wherein the lower cover comprises a connection hole passing through the lower cover.

5. The apparatus according to claim 1, wherein the lower cover comprises a connection part configured to receive power from an external source.

6. The apparatus according to claim 5, wherein the connection part is connected to the compressing member when the lower cover covers the lower side of the dust-collecting body.

7. The apparatus according to claim 1, further comprising a dust separation unit configured to separate the dust from air, wherein the dust-collecting body includes a dust-introducing part into which the dust separated in the dust separation unit is introduced.

8. A vacuum cleaner, comprising:

a main body including a suction motor configured to generate a suction force;

a dust container configured to communicate with the suction motor, the dust container including a dust-collecting body configured to store dust and a lower cover configured to open and close a lower side of the dust-collecting body;

a compressing member configured to compress the dust stored in the dust-collecting body; and a driving device configured to drive the compressing member, wherein the lower cover comprises a connection part connected to the driving device and the compressing member.

9. The vacuum cleaner according to claim 8, wherein the compressing member is movably installed with respect to the dust-collecting body.

10. The vacuum cleaner according to claim 8, wherein the dust-collecting body comprises a guide part configured to guide movement of the compressing member.

11. The vacuum cleaner according to claim 8, wherein the compressing member comprises a connection part connected to the driving device.

12. The vacuum cleaner according to claim 8, wherein the dust-collecting body comprises a fixed member that interacts with the compressing member to compress the dust.

13. The vacuum cleaner according to claim 8, wherein the driving device comprises:

a driving source; and a power transmission unit configured to transmit power of the driving source, wherein the driving source is disposed outside of the lower cover.

14. The vacuum cleaner according to claim 8, wherein the dust container comprises an upper cover configured to open and close an upper side of the dust-collecting body.

15. A dust separation apparatus of a vacuum cleaner, the apparatus comprising:

a dust-collecting body defining a dust-storing part;

a compressing member configured to compress dust stored in the dust-collecting body, the compressing member comprising a connection part configured to receive power from an external source; and a lower cover provided on a lower side of the dust-collecting body, the lower cover opening and closing the dust-storing part, wherein the lower cover comprises a connection hole passing through the lower cover.

* * * * *